US005479681A

United States Patent [19]

Muraoka

[11] Patent Number: 5,479,681

[45] Date of Patent: Jan. 2, 1996

[54] CARGO COLLAPSE PREVENTING DEVICE

[75] Inventor: Takaharu Muraoka, Chiba, Japan

[73] Assignee: Muraoka Co., Ltd., Japan

[21] Appl. No.: 181,745

[22] Filed: Jan. 21, 1994

[30] Foreign Application Priority Data

Jan. 22, 1993 [JP] Japan ..... 5-004867 U

[51] Int. Cl.[6] ..... B65D 71/02

[52] U.S. Cl. ..... 24/16 R; 24/442

[58] Field of Search ..... 24/16 R, 16 PB, 24/30.5 R, 30.5 P, 17 AP, 17 R, 17 A, 442, 306; 206/386, 597; 150/154

[56] References Cited

U.S. PATENT DOCUMENTS

| | | | |
|---|---|---|---|
| 931,631 | 8/1909 | Milhado | 24/17 A |
| 1,447,350 | 3/1923 | Larkin | 24/17 R |
| 3,371,815 | 3/1968 | Macomber | 206/597 X |
| 3,731,348 | 5/1973 | Luehne | 24/16 PB |
| 4,700,432 | 10/1987 | Fennell | 24/16 R |
| 4,868,955 | 9/1989 | Magnant et al. | 24/302 X |
| 4,874,151 | 10/1989 | Fritz | 24/16 PB X |
| 4,901,403 | 2/1990 | Larsen | 24/17 A X |
| 5,086,543 | 2/1992 | Mitchell | 24/16 PB |

FOREIGN PATENT DOCUMENTS

| | | | |
|---|---|---|---|
| 2064445 | 10/1993 | Canada | 206/597 |

*Primary Examiner*—James R. Brittain
*Attorney, Agent, or Firm*—Fish & Richardson

[57] ABSTRACT

Disclosed is a cargo collapse preventing device for preventing the cargo collapse of various kinds of cargoes palletized on a cargo-handling pallet or cart by bundling them.

The opposite ends of a sheet cover 1 wound around the cargoes C palletized on a loading platform P or wound around the cargoes C together with the loading platform P are connected and fastened to each other by a fasteners 2 such as plane fasteners. Opposite ends of the sheet cover 1 are provided with a rigid shape-keeping member 6 fixed to the sheet cover 1 perpendicularly to the winding direction of the sheet cover 1 and a handle 7 disposed to the sheet cover 1 in the vicinity of the shape-keeping member 6. The outside end portion of the sheet cover 1 overlapped on the inside end portion thereof has a slender externally extracting slit 8 cut out and opened therethrough so that the handle 7 attached to the inside end portion can be extracted to the outside therethrough.

4 Claims, 4 Drawing Sheets

CARGO COLLAPSE PREVENTING DEVICE

BACKGROUND OF THE INVENTION

1. Field of the Invention

The present invention relates to a cargo collapse preventing device for bundling various kinds of cargoes palletized on, for example, cargo-handling pallets or carts to thereby prevent the cargo collapse thereof.

2. Description of the Related Art

Cargoes such as corrugated cardboard boxes, cases and the like in which various kinds of foods, industrial products, manufactured products and the like are packaged are loaded to and unloaded from the bed of a track or stored in a warehouse in such a manner that the cargoes are palletized on loading platforms such as cargo-handling pallets or carts and moved in the unit of each loading platform so that they can be transported or stored in a lot.

When these cargoes palletized on the loading platform are transported or loaded/unloaded, they are conventionally secured by a vinyl chloride resin sheet which is wound therearound several times to prevent the cargoes from falling down or scattering to the vicinity thereof due to the cargo collapse thereof. The vinyl chloride resin sheet is wound around and secured to the cargoes by being circulated around the cargoes by making use of the adhesiveness of the sheet so that the sheet is overlapped on the cargoes several times.

Further, when cargoes are shipped from, for example, a large product processing facility, a packaging machine for entirely packaging cargoes palletized on a loading platform is previously prepared and the cargoes are packaged and secured by a shrinkable synthetic resin sheet which is shrunk by heat applied thereto.

When the vinyl chloride resin sheet wounded around cargoes to secure them becomes unnecessary in such a case that the cargoes must be taken out, the sheet is cut off. At this time, the sheet cannot be reused because it is cut, and thus it must be disposed. When the cut sheet is disposed by being burnt, however, it produces poisonous gases and a bad odor. Thus, the vinyl chloride resin sheet is disadvantageous in that it not only causes an environmental pollution by which a peripheral environment is polluted but also is expensive in cost and further a job for winding and securing the sheet around and to cargoes by circulating the sheet around the cargoes several times is time-consuming.

On the other hand, the shrink package is also disadvantageous in that it requires a large packaging machine which is entirely useless when it is sufficient to temporarily prevent the collapse of cargoes. Further, even if a part of cargoes are required to be taken out as a sample, the shrinkable sheet must be cut off as a whole in the same way as the case in which cargoes are secured by the above sheet wound therearound, and when the shrinkable sheet is broken even partly, it is very difficult to restore the sheet to prevent the collapse of the cargoes.

Thus, an object of the present invention made by taking the aforesaid circumstances into consideration is to provide a cargo collapse preventing device by which the cargo collapse of various kinds of cargoes can be prevented when they are palletized, bundled, and secured on loading platforms such as pallets and carts and loaded to and unloaded from the bed of a track or stored in a warehouse. Further, the cargo collapse preventing device can be repeatedly and unwastefully used, stored without occupying a large space when not used and simply carried and a job for securing and removing the device to and from cargoes can be easily performed.

SUMMARY OF THE INVENTION

To achieve the above object, according to the present invention, there is provided a cargo collapse preventing device including a sheet cover 1 having a length sufficient to be horizontally wound around cargoes C palletized on a predetermined loading platform P or to be vertically wound around the cargoes C together with the loading platform P and a fastening means 2 for connecting and fastening the opposite ends of the sheet cover 1 in the state that the opposite ends are overlapped each other, which comprises a pull means 5 provided with each of the opposite ends of the sheet cover 1 for causing the opposite ends to be overlapped each other and positioned, wherein the pull means 5 includes a rigid shape-keeping member 6 fixed to the sheet cover 1 substantially perpendicularly to the winding direction thereof and a handle 7 disposed to the sheet cover 1 in the vicinity of the shape-keeping member 6.

Further, the outside end portion of the sheet cover 1 overlapped on the inside end portion thereof may be provided with a slender externally extracting slit 8 cut out and opened therethrough so that the handle 7 of the pull means 5 attached to the inside end portion can be extracted to the outside therethrough.

Further, a cargo collapse preventing device including a sheet cover 1 and a fastening means 2 in the same way as the aforesaid cargo collapse preventing device has a tentatively holding means (6, 11, 21, 31) formed to any one of the opposite ends of the sheet cover 1 to be inserted between cargoes C.

The tentatively holding means is composed of a rigid shape-keeping member 6 fixed to the sheet cover 1 substantially perpendicularly to the winding direction thereof; a tentatively holding insert piece projecting from the side edge of any one of the opposite ends of the sheet cover in the longitudinal direction thereof to be inserted between the palletized cargoes; a tentatively holding insert lug with a substantially L-shaped cross section formed to the side edge of any one of the opposite ends of the sheet cover 1 in the longitudinal direction thereof to be inserted between the palletized cargoes C, the tentatively holding insert lug having a substantially L-shaped cross section at the portion thereof to be inserted; or a tentatively holding insert portion 31 which is formed to any one of the opposite ends of the sheet cover 1, gradually narrowed toward the extreme end thereof and inserted between the palletized cargoes C with the surface thereof provided with a rubber coating processing 32 for preventing slip.

According to the cargo collapse preventing device of the present invention, the sheet cover 1 bundles the cargoes C by being horizontally wound around the cargoes C palletized on the loading platform P or vertically wound around the cargoes C together with the loading platform P, and the fastening means 2 connects and fastens the opposite ends of the sheet cover 1 to each other to thereby secure the cargoes C in the bundled state.

In the pull means 5, the shape-keeping member 6 fixed to the sheet cover 1 makes the sheet cover 1 of the portion to which it is fixed rigid, and thus when the sheet cover 1 is pulled by the handle 7, the pulled portion of the sheet cover 1 is not distorted and the sheet cover 1 can be smoothly moved as a whole and a bundling job can be securely effected by the sheet cover 1.

The externally extracting slit 8 causes the handle 7 of the inside end portion of the sheet cover 1 on which the outside end portion thereof is overlapped to be extracted to the outside, and thus the cargoes C around which the sheet cover 1 wound can be tightly bundled by the opposite ends of the sheet cover 1 pulled to each other and thus the falling-down of the sheet cover 1 is prevented by the sheet cover 1 after the opposite ends are connected and fastened to each other.

The sheet cover 1 can be tentatively held while it is wound around the palletized cargoes C by inserting the tentatively holding means (6, 11, 21, 31) formed to the end of the sheet cover 1 therebetween, and thus a single worker can perform the winding job of the sheet cover 1.

DESCRIPTION OF PREFERRED EMBODIMENTS

Figure 1:
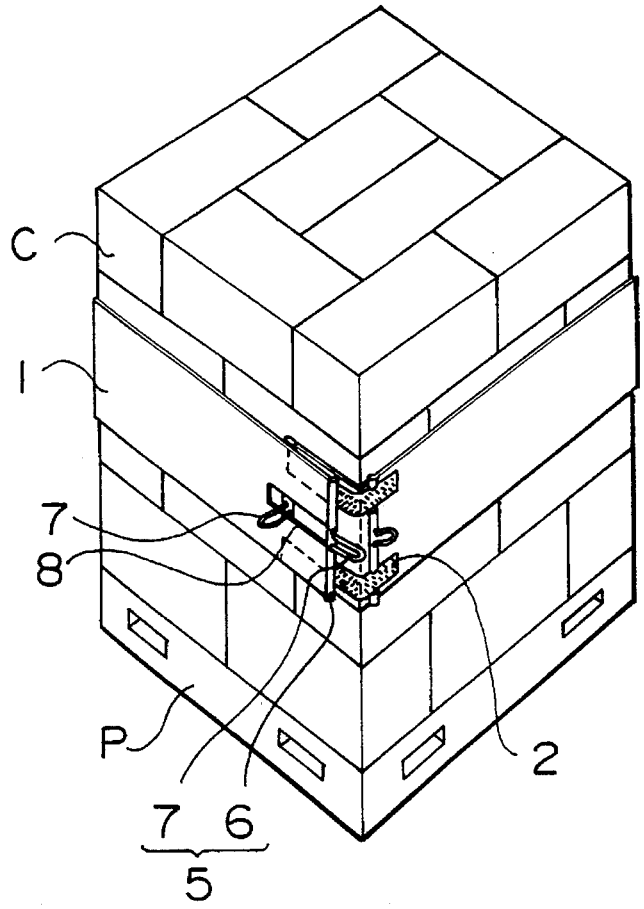
FIG. 1 is a perspective view of a cargo collapse preventing device when it is used.
Figure 2:
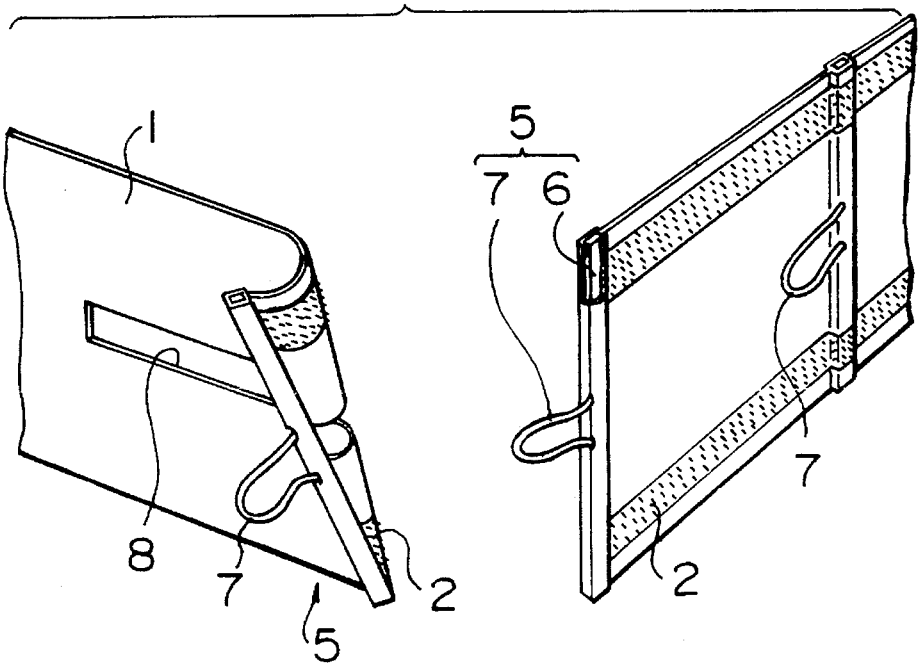
FIG. 2 is an exploded perspective view, partly in cross section, of a fastening means.
Figure 3:
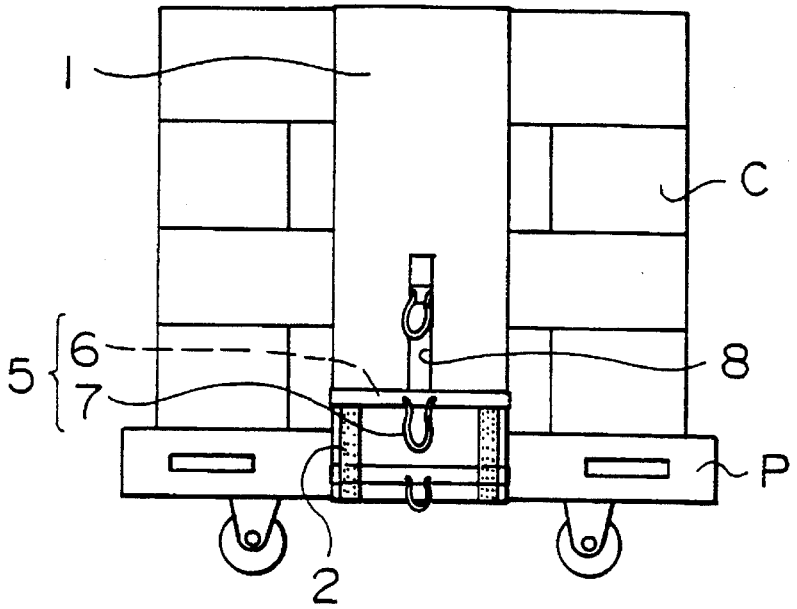
FIG. 3 is a perspective view of another cargo collapse preventing device when it is used.

An embodiment of the present invention will be described below with reference to the drawings, wherein numeral 1 designates a band-shaped sheet cover having a sufficient length and width so that the sheet cover can be wound horizontally as shown in FIG. 1 or vertically as shown in FIG. 3 around and secured to cargoes C palletized on a loading platform P such as a cargo-handling pallet or a cart.

More specifically, the sheet cover 1 is formed of a canvas sheet or the like having a predetermined thickness composed of a synthetic resin such as, for example, a nylon resin or polyester resin. When the sheet cover 1 is horizontally wound around and secured to the cargoes C, it must have a vertical width which is sufficient to cover a plurality of the cargoes C palletized in a vertical direction and a length which is sufficient to horizontally surround the cargoes and enable the opposite ends of the sheet cover to be overlapped each other (refer to FIG. 1). When the sheet cover 1 is vertically wound around and secured to the cargoes C, it must have a horizontal width which is sufficient to cover a plurality of cargoes C palletized in a horizontal direction and a length which is sufficient to vertically surround the cargoes and enable the opposite ends of the sheet cover to be overlapped each other so that the cargoes can be wounded with the sheet cover 1 together with the loading platform (refer to FIG. 3).

The sheet cover 1 includes a fastening means 2 for connecting and fastening the opposite ends of the sheet cover 1 after it is wounded around and secured to the cargoes C. The fastening means 2 in the illustrated example is composed of a plane fastener with a male structure and a plane fastener with a female structure, and one of the plane fasteners is attached to the opposite side edges in the longitudinal direction of the outside surface of the sheet cover 1 at an end thereof on which the inside surface of the sheet cover 1 at the other end is overlapped and the other of the plane fasteners is attached to the opposite side edges in the longitudinal direction of the inside surface of the sheet cover 1 at the other end thereof, one of the fasteners being free to approach to and separate from the other. These plane fasteners have a band-shape extended in the longitudinal direction of the sheet cover 1 and when, for example, the female-shaped plane fastener disposed on the outside surface of the inside portion of the sheet cover I to be overlapped with the outside portion thereof is made longer than the male-shaped plane fastener disposed on the inside surface of the outside portion, a winding length of the sheet cover 1 can be easily adjusted when it is wound around and secured to cargoes. Needless to say, the fastening means 2 is not limited to the illustrated plane fastener structure but any means such as a hook, buckle and the like may be employed so long as it can fasten the opposite ends of the sheet cover 1 each other, be detachably fastened and adjust a length of the sheet cover 1.

A pull means 5 is provided with each of the opposite ends of the sheet cover 1 so that the ends are overlapped each other and positioned. As shown in FIG. 1 to FIG. 4, the pull means 5 is composed of a bar-shaped rigid shape-keeping member 6 and a handle 7. The shape-keeping means 6 is fixed to the sheet cover 1 substantially perpendicularly to the winding direction thereof, for example, fixed by being disposed in the sheet cover 1 and the handle 7 is disposed substantially on the center line of the sheet cover 1 in the vicinity of the shape-keeping member 6.

The shape-keeping member 6 is made of, for example, an aluminium strip, pipe, bar or the like and, for example, accommodated in a bag portion defined at the end in the longitudinal direction of the sheet cover 1. When the sheet cover 1 is pulled by the handle 7, the shape-keeping member 6 ensures that the sheet cover 1 is pulled securely toward the direction in which it is pulled in a substantially straight state in particular at the opposite edges thereof without the distortion or deformation caused to the sheet cover 1 in the entire width direction thereof where the sheet cover 1 pulled. Further, the shape-keeping member 6 enables the sheet cover 1 to be forcibly inserted between the palletized cargoes C so that the sheet cover 1 can be tentatively held when it is wound around the cargoes C (refer to FIG. 4).

The handle 7 is composed of a loop-shaped string made of, for example, the same material as that of the sheet cover i and arranged such that the hand, fingers or the like of a worker inserted into the loop of the string can be held by the string. Further, the handle 7 has a strength sufficiently endurable to a pulling load which is produced when the sheet cover i is pulled as a whole. Note, this handle 7 is not limited to the case in which it is disposed substantially on the center line of the sheet cover 1, but a pair of the handles 7 may be disposed at positions in the vicinity of each of the opposite ends of the shape-keeping member 6 or a plurality of the handles 7 may be disposed to positions which are located in the direction perpendicular to the longitudinal direction of the sheet cover 1 and associated with the shape-keeping member 6. Further, when necessary, the handles 7 may be disposed to the opposite ends of the shape-keeping member 6, i.e., at the opposite edges of the sheet cover 1, and in this case the formation of an externally extracting slit 8 to be described later may not be required.

Further, as shown in the figures, the outside portion as an end of the sheet cover 1 to be overlapped with the inside portion as the other end thereof is cut out and opened to form the externally extracting slender slit 8 so that the handle 7 of the pull means 5 provided with the inside portion can be extracted to the outside. As shown in the figures, the externally extracting slit 8 is formed in the longitudinal direction of the sheet cover 1 substantially along the center line thereof to which the handle 7 is disposed and has a length corresponding to an adjustable distance necessary when the sheet cover 1 is wound around the cargoes C. Note, the number of the externally extracting slits 8 corresponds to the positions and number of the handles 7, and thus the externally extracting slit 8 is not limited to the case in which it is formed substantially along the center line of the sheet cover 1, but when a pair of the handles 7 are disposed at the positions in the vicinity of the opposite ends of the shape-keeping member 6, a pair of the externally extracting slits 8 are disposed in correspondence to the handles 7, and when a plurality of the handles 7 are disposed, the externally extracting slits 8 as many as the handles 7 are disposed at the positions corresponding to the positions of the handles 7.

It should be noted that although the pull means 5 is usually provided with each of the opposite ends of the sheet cover 1 in the longitudinal direction thereof, a plurality of the pull means are provided with any one of the opposite ends of the sheet cover 1 so that the sheet cover 1 can cover a different peripheral length of the cargoes C. For example, as the illustrated example, a plurality of the pull means 5 with suitable intervals defined therebetween are provided with the end of the sheet cover 1 where the externally extracting slit 8 is not formed, and when the sheet cover 1 is used, the excessive length portion thereof can be accommodated by, for example, being bent in a reverse direction.

Although not illustrated, a string-shaped rubber band which elastically expands and contracts may be enclosed in the opposite side edges of the sheet cover 1. When the sheet cover 1 is not needed, it can be rolled and made to a compact shape by the rubber bands, and when the sheet cover 1 is wound around and secured to the cargoes C, the cargoes C can be bundled by the rubber bands with the periphery thereof suitably tightened thereby.

Figure 5:
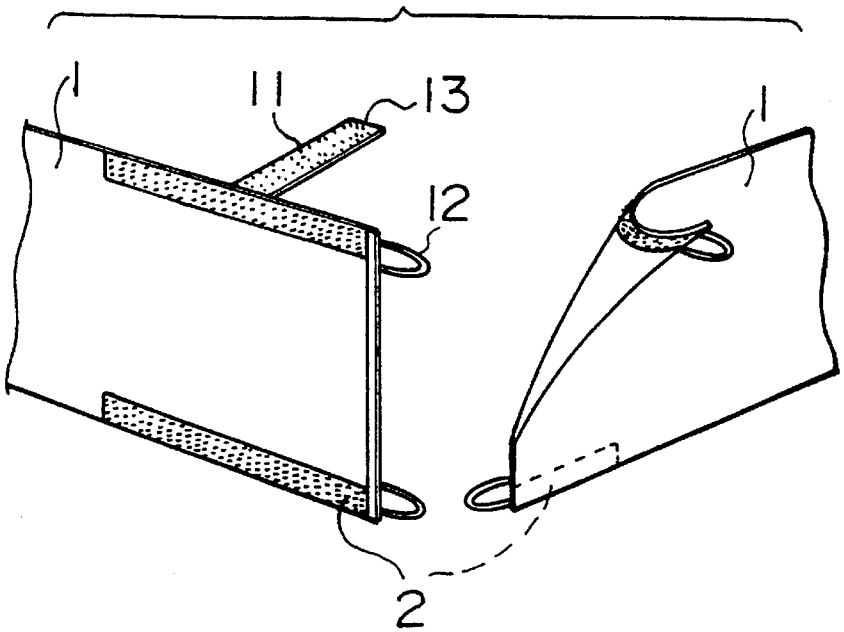
FIG. 5 is an exploded perspective view of a tentatively holding means in a second embodiment.
Figure 6:
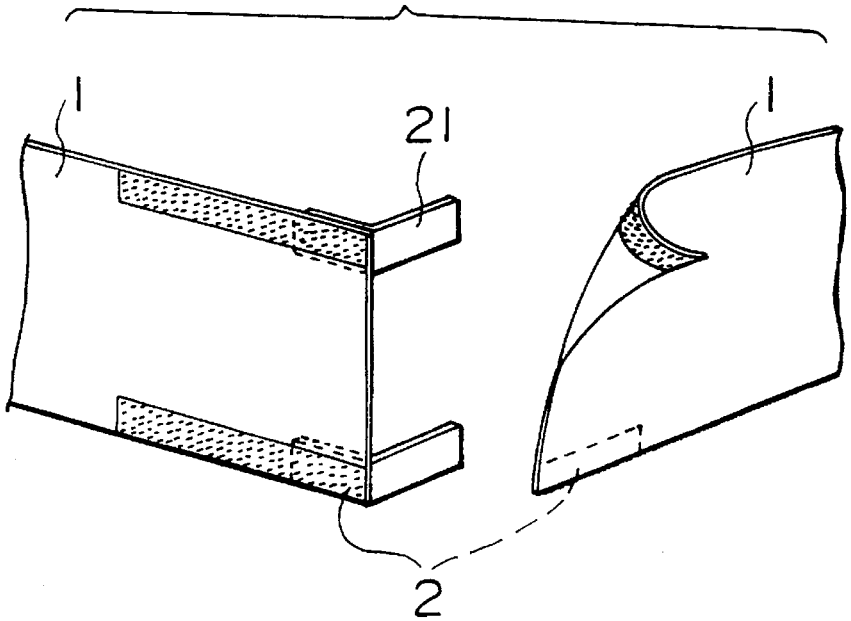
FIG. 6 is an exploded perspective view of a tentatively holding means in a third embodiment.
Figure 7:
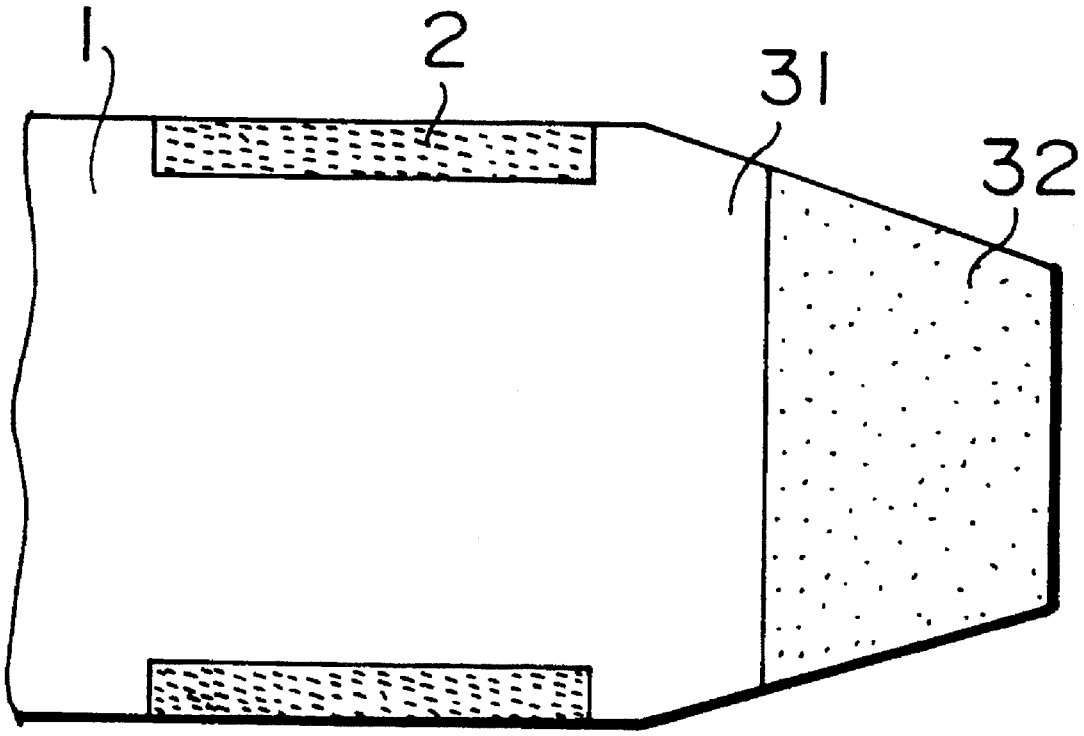
FIG. 7 is an exploded perspective view of a tentatively holding means in a fourth embodiment.

FIG. 5 to FIG. 7 show second to fourth embodiments having a different tentatively holding means in place of the first embodiment having the pull means 5 composed of the aforesaid shape-keeping member 6 and handle 7 for performing a tentatively holding action. Note, in any one of the embodiments, the opposite ends of the sheet cover 1 are connected and fastened each other in the same way as the first embodiment, and although a fastening means 2 having a plane fastener structure is employed as shown in the illustrated examples, other connecting and fastening means may be of course employed in the same way as the description of the first embodiment.

More specifically, the second embodiment shown in FIG. 5 has a tentatively holding insert piece 11 projecting from the side edge of any one of the opposite ends of the sheet cover 1 in the longitudinal direction thereof and a handle 12 provided with each of the opposite ends of the sheet cover 1, and the tentatively holding insert piece 11 is preferably formed of a material having a relatively large hardness such as a metal, rigid synthetic resin or the like so that a job for inserting the tentatively holding insert piece 11 between the cargoes C can be conveniently performed, Further, a rubber coating processing 13 or the like for preventing slip is formed on the surface of the tentatively holding insert piece 11 to prevent the extraction thereof after it is inserted between the cargoes C. The tentatively holding insert piece 11 of the second embodiment need only prevent the falling-down of the sheet cover 1 by being inserted between the cargoes C while the sheet cover 1 is wound around the cargoes C, and thus the tentatively holding insert piece 11 may formed of a soft material so long as the above object can be achieved. Further, the handle 12 is attached to each of the opposite side edges of the end of the sheet cover 1 to strongly pull the sheet cover 1 having been wound around the cargoes C so that the sheet cover 1 is securely wound around the cargoes C to secure them.

The third embodiment shown in FIG. 6 has a tentatively holding insert lug 21 provided at the edges of any one of the opposite ends of the sheet cover 1 in the longitudinal direction thereof, the tentatively holding insert lug 21 being inserted between the palletized cargoes C. The tentatively holding insert lug 21 has a substantially L-shaped cross section at the portion thereof to be inserted and is formed of, for example, a hard rubber material or a metal subjected to a rubber coating processing. When the sheet cover 1 is wound around the cargoes C, the tentatively holding insert lug 21 can pre vent the falling-down of the sheet cover 1 by being inserted between the cargoes C while the sheet cover 1 is wound around cargoes C, and when the tentatively holding insert lug 21 is removed and abutted against the corner of the cargoes C after the sheet cover 1 is wound, the sheet cover 1 can be positioned and the cargoes C can be wounded with and secured by the sheet cover 1.

The fourth embodiment shown in FIG. 7 has a tentatively holding insert portion 31 formed to any one of the opposite ends of the sheet cover 1 in the longitudinal direction thereof, tentatively holding insert portion 31 being inserted between the cargoes C. The tentatively holding insert portion 31 is gradually narrowed toward the extreme end thereof and the surface thereof is provided with a rubber coating processing 32 for preventing slip. When the sheet cover 1 is wound around the cargoes C, the tentatively holding insert portion 31 can prevent the falling down of the sheet cover 1 by being inserted between cargoes C and when the tentatively holding insert portion 31 is removed and abutted against the outer periphery of the cargoes C after the sheet cover 1 is wound, the sheet cover 1 can be positioned and the cargoes C can be wounded with and secured by the sheet cover 1.

Since the above embodiments are need only be arranged such that sheet cover 1 is inserted between the cargoes C at any one of the opposite ends in the longitudinal direction thereof and tentatively held therebetween and after the sheet cover 1 is wound around the cargoes C, the inserted end is removed and the opposite ends of the sheet cover 1 are suitably connected to each other and fastened, the embodiments are not of course limited to the illustrated structures, configurations and the like.

Figure 4:
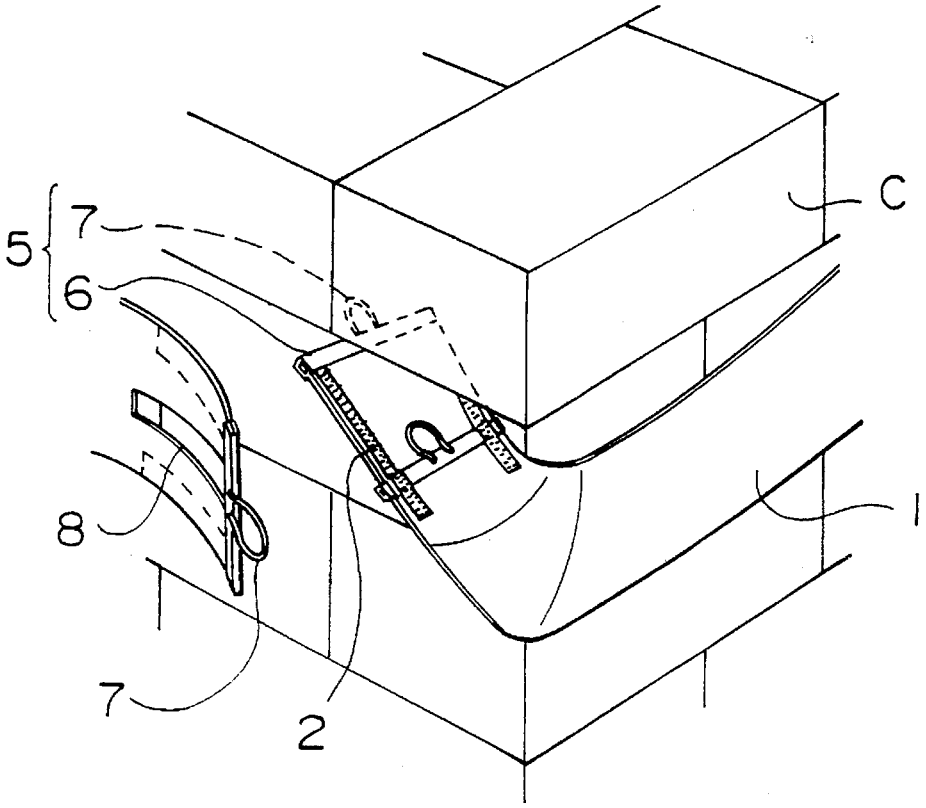
FIG. 4 is a perspective view of the main portion of a cargo collapse preventing device when it is secured to cargoes by being wound therearound with an end of the device inserted between cargoes.

Next, an example of use of the device according to the present invention will be described with respect to the case of first embodiment. As shown in FIG. 4, any one of the opposite ends of the sheet cover 1 which is made rigid by the shape-keeping member 6 of the pull means 5 enclosed therein, e.g., the end on the side of the sheet cover 1 where the externally extracting slit 8 is not formed is forcibly inserted between the cargoes C. Then, the sheet cover 1 which is tentatively held by the end inserted between the cargoes C is wound therearound, the other end on the side of the sheet cover 1 where the externally extracting slit 8 is formed is overlapped on the outside surface of the above end and the handle 7 located at the end is extracted to the outside of the sheet cover 1 through the externally extracting slit 8, as shown in FIG. 1. Next, the handles 7 of the pull means 5 located at the opposite ends of the sheet cover 1 are pulled to each other so that the sheet cover 1 comes into intimate contact with the periphery of the cargoes C and the overlapped ends are connected and fastened to each other by the fastening means 2.

At this time, the cargoes C on the loading platform P may be either horizontally wound by the sheet cover 1 as shown in FIG. 1 or vertically wound together with the loading platform P by the sheet cover 1 as shown in FIG. 3, and the horizontal winding and vertical winding may be suitably selected depending upon the conditions under which the cargoes C are loaded, unloaded or transported.

Since the present invention is arranged as described above, various kinds of the cargoes C palletized on the loading platform P such as the cargo-handling pallet or cart can be bundled and secured by the sheet cover 1 wound around and secured to the cargoes C, and thus when the cargoes C are loaded to and unloaded from the bed of a track or stored in a warehouse, the cargo collapse of them can be prevented. Further, since the tentatively holding means (6, 11, 21, 31) at an end of the sheet cover 1 need only be inserted and tentatively held between the cargoes C and then the sheet cover 1 is wound around the cargoes C in this state, this job can be performed by a single worker. After the sheet cover 1 is wound around the cargoes C, the cargoes C can be firmly secured by connecting and fastening the opposite ends of the sheet cover 1 to each other by the and fastening means 2.

Further, when the sheet cover 1 is not needed, it can be easily removed from the cargoes C by releasing and separating the fastening means 2. Further, since the sheet cover 1 can be repeatedly used, it is not wasteful and can solve the problem of the conventional environmental pollution which is caused by the disposal a vinyl chloride resin sheet. In addition to the above, the sheet cover 1 can be stored and carried in a compact shape by being folded when not necessary and thus can be quickly used in a job for loading, unloading and transporting the cargoes C.

Further, since the sheet cover 1 can be wound around the cargoes C together with the loading platform P, it can be easily used to the display of various commodities in supermarkets, large-scale retailing shops and the like, the movement of documents in offices and the like, the movement of products in factories, the delivery of articles performed by forwarding agents, and the like.

More specifically, according to the present invention, the sheet cover 1, which is wounded around the palletized cargoes C or wound around the palletized cargoes C together with the loading platform P and whose opposite ends are connected and fastened to each other by the fastening means 2, is provided with the pull means 5 including the bar-shaped rigid shape-keeping member 6 fixed to the sheet cover 1 substantially perpendicularly to the winding direction thereof and the handle 7 disposed to the sheet cover 1 in the vicinity of the shape-keeping member 6, and further the tentatively holding means (6, 11, 21, 31) to be inserted between the cargoes C is formed to any one of the opposite ends of the sheet cover 1, and thus various kinds of the palletized cargoes C are bundled to thereby prevent the cargo collapse thereof.

Further, when the opposite ends of the sheet cover 1 is overlapped and connected to each other by being pulled by the pull means 5, since the outside portion of the opposite ends of the overlapped sheet cover 1 has the slender externally extracting slit 8 formed thereto by cutting out and opening the outside portion to cause the handle 7 of the pull means 5 provided with the inside portion thereof to be extracted to the outside, the handle 7 of the inside portion of the overlapped opposite ends of the sheet cover 1 can be extracted to the outside through the externally extracting slit 8 so that a job for pulling the opposite ends can be very easily performed. As a result, the sheet cover 1 can be tightly wounded around the cargoes C. Moreover, when the sheet cover 1 is pulled by the handle 7, since the rigid shape-keeping member 6 is fixed to the sheet cover 1 substantially perpendicularly to the winding direction thereof, the sheet cover 1 can smoothly move without causing distortion to the portion of the sheet cover 1 to which the shape-keeping member 6 is fixed as a whole. Therefore, the sheet cover 1 can be fastened by the fastening means 2 without wrinkles caused to it as a whole in the state that the sheet cover 1 is firmly wounded around the cargoes C. Consequently, after the cargoes C are wounded and secured by the sheet cover 1, the sheet cover 1 does not fall down as well as the cargoes C are not damaged by being excessively tightened even partly.

Further, since the sheet cover 1 is provided with the shape-keeping member 6 fixed thereto and the tentatively holding means such as the tentatively holding insert piece 11 projecting from the side edge of the end of the sheet cover 1, the tentatively holding insert lug 21 provided at the end edge of the sheet cover 1 and having the substantially L-shaped cross section, the tentatively holding insert portion 31 formed to the end of the sheet cover 1, and the like, when the tentatively holding means is inserted between the palletized cargoes C, an end of the sheet cover 1 can be tentatively held while it is wound around the cargoes C, and thus the sheet cover 1 can be wound around and fastened to the cargoes C by a single worker, whereby this device can provide excellent workability.

Further, since the sheet cover 1 is detachably connected and fastened to each other by the fastening means 2, when the cargoes 2 must be partly taken out after the sheet cover 1 is wound around and fastened to them, the sheet cover 1 can be easily removed and after the cargoes is partly taken out, the sheet cover 1 can be easily wound around and tightly fastened to the cargoes C again.

Furthermore, since the sheet cover 1 has a breadth_ large enough for printing, for example, advertisement copy thereon. It is thus possible to use the sheet cover 1 as an advertisement medium.

What is claimed is:

1. A cargo collapse preventing device including a sheet cover having opposite ends and having a length sufficient to be horizontally wound around cargoes palletized on a predetermined loading platform or to be vertically wound around the cargoes together with the loading platform and a fastening means for connecting and fastening the opposite ends of the sheet cover in the state that the opposite ends are overlapped each other defining inside and outside end portions, comprising a pull means provided with each of the opposite ends of said sheet cover for causing the opposite ends to be overlapped each other and positioned, wherein said pull means includes a rigid shape-keeping member fixed to said sheet cover substantially perpendicularly to the winding direction thereof and a handle disposed to said sheet cover in the vicinity of said shape-keeping member, and wherein the outside end portion of said sheet cover overlapped on the inside end portion thereof has a slender externally extracting slit cut out and opened therethrough so that the handle of said pull means attached to the inside end portion can be extracted to the outside therethrough.

2. A cargo collapse preventing device including a sheet cover having side edges and opposite ends extending between said side edges and having a length sufficient to be horizontally wound around cargoes palletized on a predetermined loading platform or to be vertically wound around the cargoes together with the loading platform and a fastening means for connecting and fastening the opposite ends of the sheet cover in the state that the opposite ends are overlapped each other, comprising a tentatively holding means formed to any one of the opposite ends of said sheet cover to be inserted between said cargoes, wherein said tentatively holding means is composed of a tentatively holding insert lug formed to the side edge of any one of the opposite ends of said sheet cover in the longitudinal direction thereof to be inserted between said palletized cargoes, .said tentatively holding insert lug having a substantially L-shaped cross section at the portion thereof to be inserted.

3. A cargo collapse preventing device according to claim 2, wherein said tentatively holding insert lug is a rigid shape-keeping member fixed to said sheet cover substantially perpendicularly to the winding direction thereof.

4. A cargo collapse preventing device according to claim 2, wherein said tentatively holding insert lug is provided with a rubber coating for preventing slip after having been inserted between palletized cargoes.

* * * * *

UNITED STATES PATENT AND TRADEMARK OFFICE

CERTIFICATE OF CORRECTION

PATENT NO. : 5,479,681

DATED : January 2, 1996

INVENTOR(S) : Muraoka

It is certified that error appears in the above-identified patent and that said Letters Patent is hereby corrected as shown below:

Col. 4, line 51, "i" should be --1--.
line 55, "i" should be --1--.

Col. 8, line 41, "breadth_" should be --breadth--.

Col. 10, line 2, line 1, ".said" should be --said--.

Signed and Sealed this

Eighteenth Day of March, 1997

Bruce Lehman

*Attest:*

BRUCE LEHMAN

*Attesting Officer*

*Commissioner of Patents and Trademarks*